US010393140B2

(12) United States Patent
Osawa

(10) Patent No.: US 10,393,140 B2
(45) Date of Patent: Aug. 27, 2019

(54) FLUID PUMP

(71) Applicant: TBK Co., Ltd., Machida-shi, Tokyo (JP)

(72) Inventor: Makoto Osawa, Yokohama (JP)

(73) Assignee: TBK CO., LTD., Tokyo (JP)

( * ) Notice: Subject to any disclaimer, the term of this patent is extended or adjusted under 35 U.S.C. 154(b) by 425 days.

(21) Appl. No.: 15/046,008

(22) Filed: Feb. 17, 2016

(65) Prior Publication Data

US 2017/0108002 A1 Apr. 20, 2017

(30) Foreign Application Priority Data

Oct. 20, 2015 (JP) ..... 2015-206616

(51) Int. Cl.
*F04D 29/40* (2006.01)
*F04D 25/02* (2006.01)
(Continued)

(52) U.S. Cl.
CPC ..... *F04D 29/406* (2013.01); *F01P 3/18* (2013.01); *F01P 5/12* (2013.01); *F04D 13/02* (2013.01); *F04D 13/024* (2013.01); *F04D 25/026* (2013.01); *F04D 29/046* (2013.01); *F04D 29/106* (2013.01); *F04D 29/126* (2013.01); *F04D 29/22* (2013.01);
(Continued)

(58) Field of Classification Search
CPC .... F04D 13/024; F04D 25/026; F04D 29/126; F04D 29/106; F05D 2240/55; F05D 2260/6022
See application file for complete search history.

(56) References Cited

U.S. PATENT DOCUMENTS 5,954,120 A * 9/1999 Aoki ..... F24J 3/003 126/247
7,775,765 B2 * 8/2010 Hoji ..... F04D 13/021 415/168.1
(Continued)

FOREIGN PATENT DOCUMENTS

EP 2930368 A1 * 10/2015 ..... F04D 13/022
JP 2007-16629 A 1/2007
(Continued)

OTHER PUBLICATIONS

Office Action dated Jun. 25, 2019, issued in counterpart JP Application No. 2015-206616, with English machine translation. (6 pages).

*Primary Examiner* — Ninh H. Nguyen
(74) *Attorney, Agent, or Firm* — Westerman, Hattori, Daniels & Adrian, LLP

(57) ABSTRACT

The fluid pump according to the present invention has water storage means that is formed so as to communicate with a shaft hole in a pump case and stores fluid leaking from a mechanical seal. An electromagnetic clutch establishes or blocks the transmission of power to a drive shaft by switching between supply and non-supply of electricity to an excitation coil. The water storage means has a weep chamber that communicates with the shaft hole between the mechanical seal and a bearing and is opened to an end portion in the axial direction. An attachment member for attaching a core of the electromagnetic clutch to the pump case seals the opening of the weep chamber.

1 Claim, 4 Drawing Sheets

(51) Int. Cl.

| | |
|---|---|
| ***F04D 29/12*** | (2006.01) |
| ***F01P 3/18*** | (2006.01) |
| ***F01P 5/12*** | (2006.01) |
| ***F04D 13/02*** | (2006.01) |
| ***F04D 29/046*** | (2006.01) |
| ***F04D 29/10*** | (2006.01) |
| ***F04D 29/22*** | (2006.01) |

(52) U.S. Cl.
CPC ..... *F05B 2240/14* (2013.01); *F05B 2240/30* (2013.01); *F05B 2240/50* (2013.01); *F05B 2240/57* (2013.01); *F05B 2260/603* (2013.01); *F05D 2240/55* (2013.01); *F05D 2260/6022* (2013.01)

(56) References Cited

U.S. PATENT DOCUMENTS

| | | | | |
|---|---|---|---|---|
| 8,794,909 | B2 * | 8/2014 | Lee | F04D 13/027 415/123 |
| 9,140,313 | B2 * | 9/2015 | Ikegawa | F16D 27/105 |

FOREIGN PATENT DOCUMENTS

| | | | | |
|---|---|---|---|---|
| JP | 2011-202526 | A | 10/2011 | |
| JP | 2013-60830 | A | 4/2013 | |
| JP | 2014-109261 | A | 6/2014 | |
| JP | WO 2014087845 | A1 * | 6/2014 | F04D 13/022 |

* cited by examiner

FLUID PUMP

RELATED APPLICATIONS

This invention claims the benefit of Japanese Patent Application No. 2015-206616 which is hereby incorporated by reference.

TECHNICAL FIELD

The present invention relates to a fluid pump such as a water pump.

TECHNICAL BACKGROUND

Water-cooled engines such as automotive engines have conventionally been using water (cooling water) as a medium for cooling the cylinders and cylinder head and have a fluid pump as a device for forcibly circulating the cooling water by feeding the cooling water to a water jacket formed within the cylinder block of the engine. Such a fluid pump is typically called "water pump," and has a pump base configured from a part of the cylinder block and having an inlet port and an outlet port for the cooling water, a pump case attached to the pump base and configuring a pump chamber, a pump pulley supported rotatably in an outer circumferential portion of the pump case, a drive shaft that has one end portion coupled to the pump pulley and extends inside the pump chamber through a shaft hole of the pump case, a bearing for supporting the drive shaft rotatably, and an impeller attached to an end portion of the drive shaft and provided inside the pump chamber (see Japanese Laid-Open Patent Publication No. 2007-16629 (A), for example). Additionally, a variable fluid pump has been proposed in recent years in which an electromagnetic clutch is disposed in order to activate or deactivate the power transmission path between a pump pulley and a drive shaft, wherein the power transmission path is deactivated to limit supply of the cooling water when the engine is cool, and the power transmission path is activated to supply the cooling water when the engine is warm (see Japanese Laid-Open Patent Publication No. 2011-202526 (A), for example).

Such a water pump configured as described above is provided with sealing means for keeping the space between the shaft hole of the pump case and the drive shaft fluid-tight in order to keep the pump chamber sealed. As the sealing means, the one called "mechanical seal" configured from a first sealing member attached to the pump case and a second member attached to the drive shaft is usually used, wherein the both sealing members are brought into contact with each other to form a sealing surface.

SUMMARY OF THE INVENTION

In such a fluid pump configured as described above, however, when the mechanical seal involves foreign matters such as dust, there is a possibility that a small amount of cooling water leaks from the mechanical seal. This is structurally inevitable as long as a mechanical seal is employed as the sealing means, and if the leaked cooling water leaks from the fluid pump to the outside, there is a risk of misjudging that the fluid pump has broken down. The fluid pump described in Japanese Laid-Open Patent Publication No. 2007-16629 (A) suggests a configuration in which a water storage space is provided on the inside of the pump case for the purpose of temporarily storing the cooling water that has leaked from the mechanical seal. However, this configuration requires a special cover for removably sealing the opening of the water storage space, leading to an increase in the number of parts or mounting processes and thus the cost of manufacturing the fluid pump.

The present invention was contrived in view of the foregoing problems, and an object thereof is to provide a fluid pump that is structured to prevent the fluid from leaking to the outside, without having to increase the number of parts or mounting processes.

In order to achieve the foregoing object, a fluid pump according to the present invention is a fluid pump having: a housing (e.g., a pump case 10 according to an embodiment) that has a shaft hole extending an axial direction and a pump chamber communicating with the shaft hole; a drive shaft that is provided inside the shaft hole and rotated about an axis by power from a power source (e.g., an engine EG according to the embodiment); a rotational bearing (e.g., a bearing 17 according to the embodiment) provided inside the shaft hole and supporting the drive shaft rotatably; an impeller that is provided inside the pump chamber and coupled to an end portion of the drive shaft; an electromagnetic clutch that is provided in the housing and establishes or blocks transmission of the power of the power source to the drive shaft; a mechanical seal that is located between the impeller and the rotational bearing and is configured by a first sealing member and a second sealing member facing in contact with each other, the first sealing member being provided in an inner circumferential portion of the shaft hole and the second sealing member being provided in an outer circumferential portion of the drive shaft; and storage means (e.g., water storage means 100 according to the embodiment) that is formed so as to communicate with the shaft hole in the housing and stores fluid leaking from the mechanical seal, wherein the electromagnetic clutch has a core portion (e.g., a core 72 according to the embodiment) that houses a coil for generating a magnetic field (e.g., an excitation coil 73 according to the embodiment), and establishes or blocks the transmission of the power of the power source to the drive shaft by switching between supply and non-supply of electricity to the coil, the storage means has a fluid storage portion (e.g., a weep chamber 102 according to the embodiment) that communicates with the shaft hole between the mechanical seal and the rotational bearing and is opened to an end portion in the axial direction, and an attachment member for attaching the core portion to the housing seals the opening of the fluid storage portion.

In the fluid pump with the foregoing configuration, it is preferred that the fluid storage portion be configured from an annular space forming a circle around the axis, and that a discharge portion that connects the fluid storage portion to the outside be provided at a predetermined height from a lower end of the fluid storage portion and be directed obliquely downward from the fluid storage portion toward the outside.

The housing of the fluid pump according to the present invention is provided with the fluid storage portion for storing the fluid leaking from the mechanical seal. Therefore, by using the attachment member of the electromagnetic clutch as a cover for sealing the opening of the fluid storage portion, water leakage front the fluid pump can be prevented without using a special cover, thereby reducing the number of parts and assembly processes of the fluid pump and thus the cost of manufacturing the fluid pump.

In the fluid pump with the foregoing configuration, the fluid storage portion is formed as an annular space forming a circle around the axis, to efficiently secure a spatial volume in the fluid storage portion. Therefore, even when the cooling water leaks from the mechanical seal in the form of water vapor, the amount of water vapor, which is required until the foregoing water vapor condenses, increases in the fluid storage portion, preventing the formation of dew condensation in the fluid storage portion. Therefore, water leakage from the fluid pump can be prevented more effectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

DESCRIPTION OF THE EMBODIMENTS

A preferred embodiment of the present invention is described hereinafter with reference to the drawings. A water pump (fluid pump) according to an embodiment of the present invention is provided on the inside of a cooling water circulation passage to forcibly circulate the cooling water. Before explaining the water pump of the present embodiment, this cooling water circulation passage is described first with reference to FIG. 1.

Figure 1:
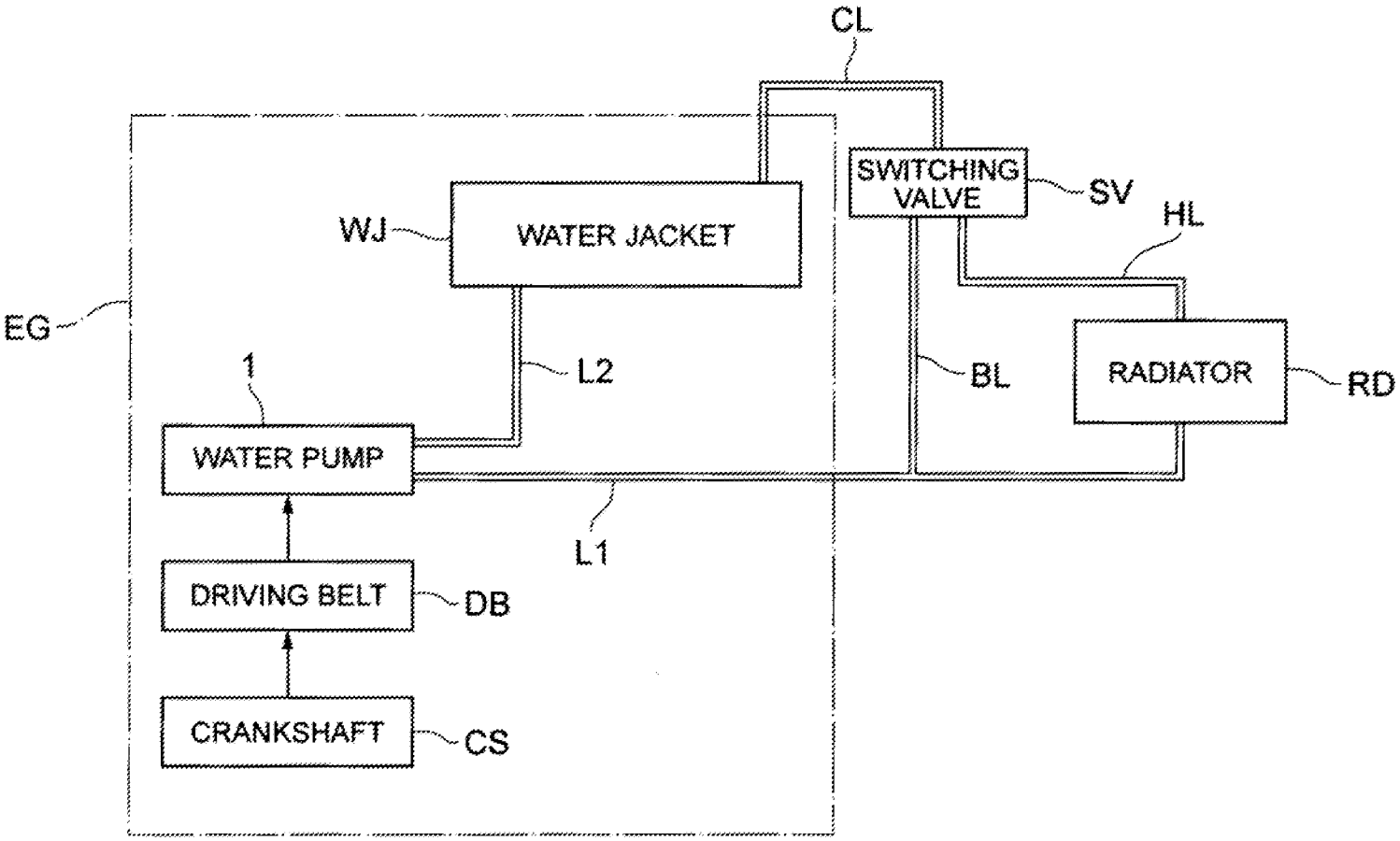
FIG. 1 is a block diagram showing a circulation passage in which cooling water is caused to circulate by a water pump according to an embodiment.

As shown in FIG. 1, an engine EG as a water-cooled internal combustion engine, a radiator RD for cooling the cooling water (a medium for cooling the engine) discharged from the engine EG, a switching valve SV for controlling the circulation of the cooling water in accordance with the temperature of the cooling water, and a water pump 1 for forcibly circulating the cooling water, are disposed on the inside of the cooling water circulation passage, wherein the engine EG is cooled by the circulation of the cooling water through a plurality of flow paths.

The engine EG is, for example, a water-cooled gasoline engine which is provided with a water jacket WJ that is formed as a space to cover the cylinders (not shown) of the engine. The cooling water enters the water jacket WJ from an outlet flow path L2, cools the cylinders and the like while passing through the water jacket WJ, and is then discharged to a connective flow path CL.

With the air from a cooling fan, not shown, the radiator RD cools the cooling water passing through the radiator RD and releases the heat to the outside. Thus, the cooling water that is warmed up in the water jacket WJ of the engine EG releases heat while passing through the radiator RD, thereby reducing its water temperature.

The switching valve SV is connected to the radiator RD by a discharge flow path HL and to a bypass flow path BL that bypasses the radiator RD. The switching valve SV is configured from a thermostat (a cooling water-sensitive switching valve) that opens/closes in accordance with the temperature of the cooling water. The switching valve SV connects the connective flow path CL with the bypass flow path BL when the temperature of the cooling water is equal to or lower than a predetermined temperature, and connects the connective flow path CL with the discharge flow path HL when the temperature of the cooling water exceeds the predetermined temperature.

The water pump 1 has its rotating shaft coupled to a crankshaft CS of the engine EG by a driving belt DB or the like and is activated in conjunction with the operation of the engine EG. A inlet flow path L1 and the outlet flow path L2 are connected to the water pump 1, wherein the cooling water that is suctioned through the inlet flow path L1 is pressurized and supplied from the outlet flow path L2 to the water jacket WJ.

In this cooling water circulation passage, the cooling water that is discharged from the water pump 1 through the outlet flow path L2 flow into the water jacket WJ formed within the engine EG, cools the engine EG, and is discharged. The discharged cooling water is cooled by the radiator RD or returns from the inlet flow path L1 to the water pump 1 without passing through the radiator RD.

Figure 2:
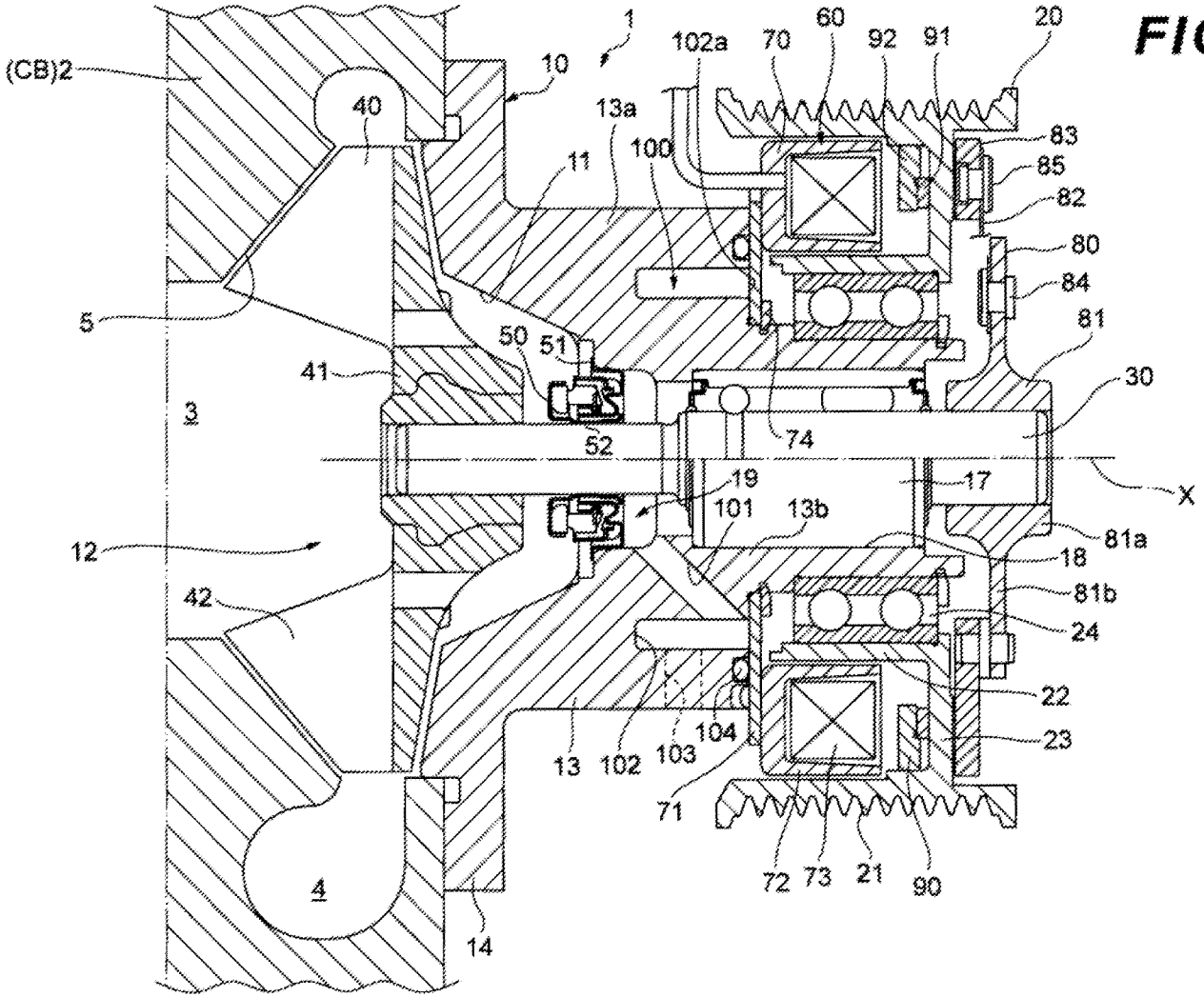
FIG. 2 is a cross-sectional diagram of the water pump.
Figure 3:
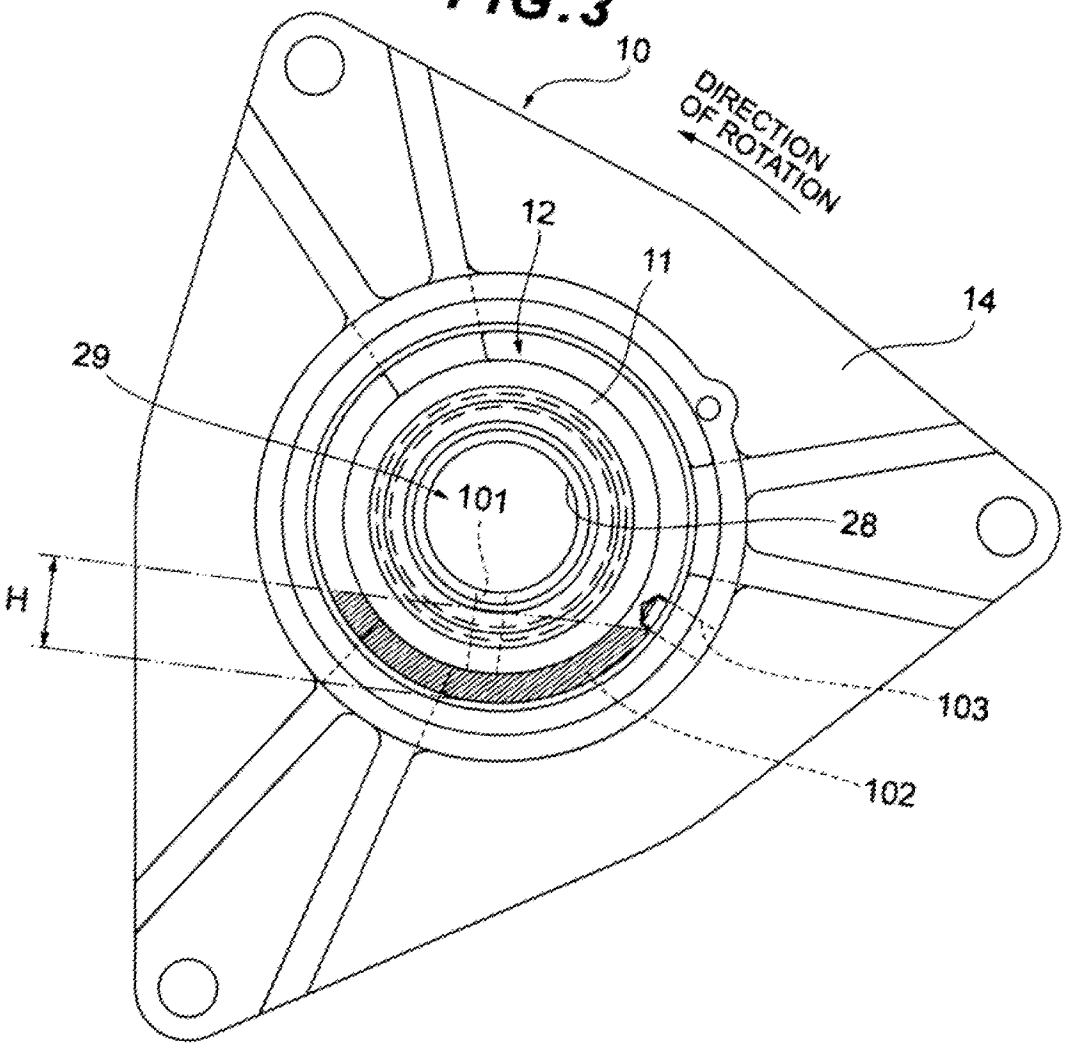
FIG. 3 is a plan view of a pump case of the water pump.
Figure 4:
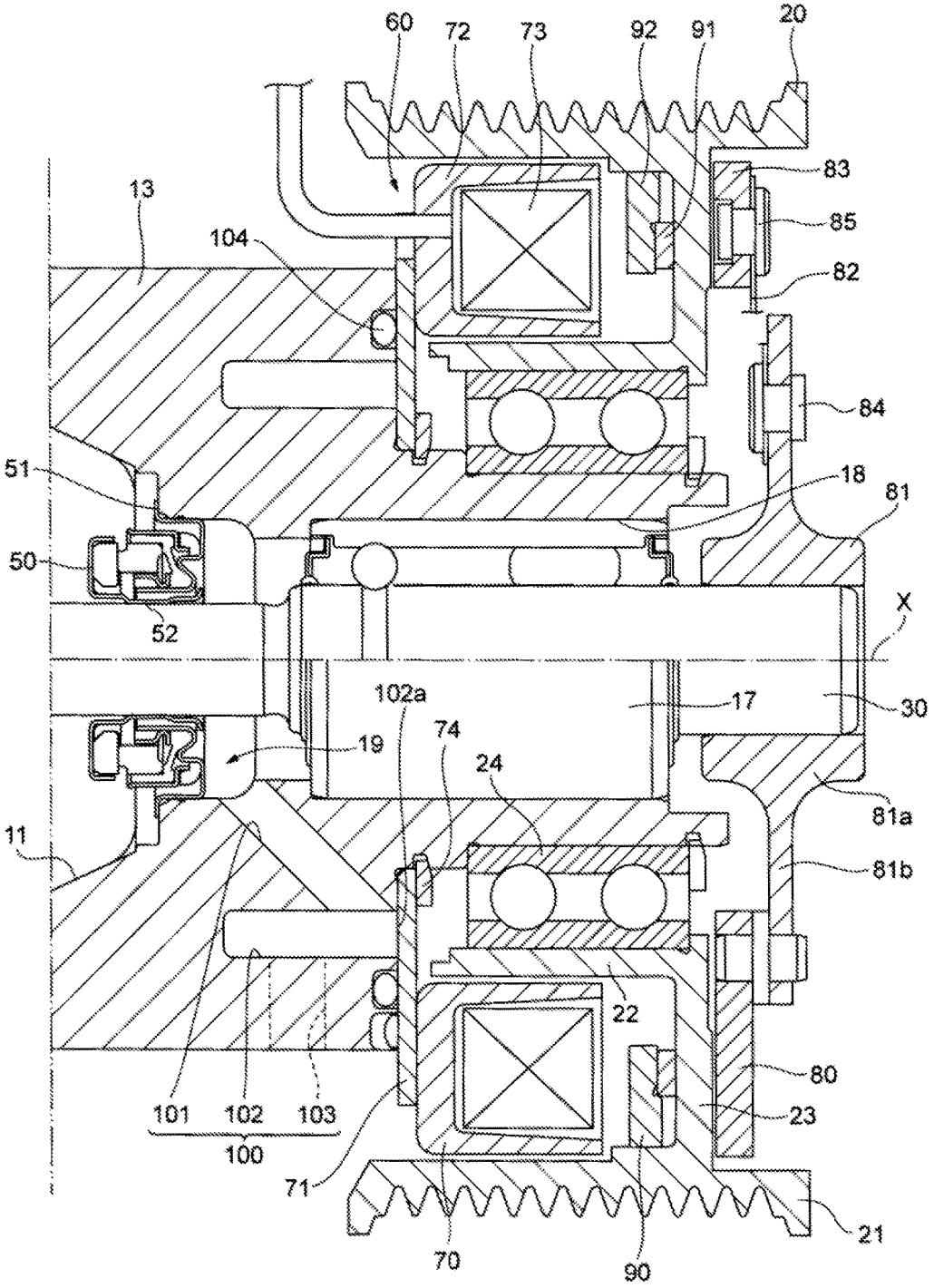
FIG. 4 is a cross-sectional diagram showing substantial parts of the water pump.

The overall configuration of the water pump 1 is described next with reference to FIGS. 2 to 4. For the convenience of explanation, the left-hand side in the axial direction is described hereinafter as "one end side" and the right-hand side in the axial direction as "the other end side," based on the arrangement in the water pump 1 shown in FIG. 2.

The water pump 1 is configured mainly from a pump case 10 that is attached to a pump base 2 configuring a part of a cylinder block CB of the engine EG, a drive shaft 30 that is attached to the pump case 10 with a bearing 17 therebetween in such a manner as to be rotatable about an axis X, an impeller 40 attached to an end portion of the drive shaft 30, a mechanical seal 50 for sealing the space between the pump case 10 and the drive shaft 30 in a fluid-tight manner, an electromagnetic clutch 60 for establishing or blocking transmission of a driving force (power) of the engine EG to the drive shaft 30, and water storage means 100 for storing the cooling water leaking from the mechanical seal 50.

The pump base 2 is provided with an inlet port 3 that is connected to the cooling water inlet flow path L1, and an outlet port 4 that is connected to the cooling water outlet flow path L2. The pump base 2 also has a depressed portion 5 facing the pump case 10, which is located on the other end side.

The pump case 10 is attached removably to the pump base 2 with a plurality of bolts, and a pump chamber 12 is formed between the depressed portion 5 of the pump base 2 that is formed on the other end side and a depressed portion 11 of the pump case 10 that is formed on the one end side. The pump case 10 has a hollow cylindrical portion 13 and a flange portion 14 that extends radially outward from one end portion of the cylindrical portion 13. The cylindrical portion 13 has a large diameter portion 13*a* and a small diameter portion 13*b* and is entirely formed into a stepped cylinder. A pump pulley 20 is attached coaxially to an outer circumferential portion of the small diameter portion 13*b* with a bearing 24 therebetween. A shaft hole 18 penetrates through the center of the pump case 10 in the axial direction.

The pump pulley 20 has a pulley portion 21 around which the driving belt DB connected to the crankshaft CS is stretched, a support 22 that has the bearing 24 fitted into its inner circumference, and a coupling portion 23 for coupling the pulley portion 21 and the support 22 to each other, wherein a driving force of the crankshaft CS is transmitted to the pump pulley 20 via the driving belt DB. An end surface of the coupling portion 23 at the other end side is configured as a friction surface that comes into frictional engagement with an armature 83 described hereinafter.

The drive shaft 30 is supported in the pump case 10 so as to be rotatable with the bearing 17 fitted into the shaft hole 18 of the pump case 10. The impeller 40 is attached coaxially to one end of the drive shaft 30. The space between the shaft hole 18 of the pump case 10 and the drive shaft 30 is sealed with the mechanical seal 50 for keeping the pump chamber 12 sealed. The mechanical seal 50 is configured from a first sealing member 51 fixed to an inner circumferential surface of the shaft hole 18 of the pump case 10 and a second sealing member 52 fixed to an outer circumferential surface of the drive shaft 30, wherein the sealing members 51, 52 face each other and come into sliding contact with each other in the axial direction to keep the pump chamber 12 sealed. Between the mechanical seal 50 and the bearing 17 is a draining space 19 configuring a part of the shaft hole 18, into which the cooling water (moisture) leaking from the mechanical seal 50 flows.

The impeller 40 has a central "hub" portion 41 into which the drive shaft 30 is press-fitted, and a plurality of vanes 42 provided at one end of the central "hub" portion 41. When the impeller 40 rotates integrally with the drive shaft 30, the cooling water is suctioned from the inlet port 3 of the pump base 2 into the pump chamber 12 and discharged through the outlet port 4 of the pump base 2 through the spaces between the vanes 42.

The electromagnetic clutch 60 is configured from a field core assembly 70 attached to the pump case 10, an armature assembly 80 attached to the drive shaft 30, and a magnet portion 90 attached to the pump pulley 20.

The field core assembly 70 has an attachment member 71 attached removably to an end surface of the large diameter portion 13*a* at the other end side, a core 72 fixed to the attachment member 71, and the excitation coil 73 wound on the inside of the core 72, wherein a magnetic field is generated by supplying electricity to the excitation coil 73 with control means, not shown. The excitation coil 73 is housed in the core 72 and molded with insulating resin.

The armature assembly 80 has a hub 81 fixed to the drive shaft 30, a plate spring 82 functioning as an elastic member and attached to the hub 81, and the armature 83 supported so as to be movable to the hub 81 via the plate spring 82. The hub 81 has a boss portion 81a into which the other end portion of the drive shaft 30 is press-fitted, and a disc-shaped flange portion 81*b* provided integrally in the outer circumference of the boss portion 81a, and is configured to be able to rotate integrally with the drive shaft 30 about a center of the axis X. The plate spring 82 is shaped into a band by punching a spring steel material and is provided between the hub 81 and the armature 83 in such a manner as to be elastically deformable substantially in the plate thickness direction, by fastening a base end (fixed end) thereof to the hub 81 using a rivet 84 and fastening a tip end (free end) of the same to the armature 83 using a rivet 85. The armature 83 is shaped into a hollow disc using a magnetic material and attached to the tip end (free end) of the plate spring 82 in such a manner as to be movable relatively with respect to the hub 81 in the axial direction. The armature 83 is biased by the elastic force of the plate spring 82, to be separated from the pump pulley 20. The end surface of the armature 83 facing the pump pulley 20 (the end surface on the one end side) is configured as a friction surface capable of coining into frictional engagement with the friction surface of the pump pulley 20.

The magnet portion 90 has a permanent magnet 91 for magnetically drawing the armature 83 to bring the friction surface of the armature 83 into abutment with the friction surface of the pump pulley 20, and an outer pole plate 92 for fixing the permanent magnet 91 to the pump pulley 20. The permanent magnet 91 generates a magnetic field in a direction of drawing the armature 83 (direction opposite to the magnetic field of the field core assembly 70). Using a magnetic material, the outer pole plate 92 is shaped into a ring having an L-shaped cross section, and with the permanent magnet 91 fitted therein, the outer pole plate 92 is fixed to the inner circumference of the pulley portion 21.

The water storage means 100 has a drainage 101 that communicates with the draining space 19 configuring a part of the shaft hole 18 and extends obliquely downward, and a weep chamber 102 that communicates with the drainage 101 and stores the cooling water leaking from the mechanical seal 50.

The drainage 101 extends obliquely radially outward from the one end side to the other end side in the axial direction. This drainage 101 is formed by perforation using a cutting tool such as a drill or a reamer. The drainage 101 is formed between the draining space 19 and the weep chamber 102 and allows the cooling water, which leaks from the mechanical seal 50 toward the draining space 19, to flow by its own weight toward the weep chamber 102.

The weep chamber 102 is configured as an annular space forming a circle around the axis, and is opened in the end surface of the large diameter portion 13*a* at the other end side. This weep chamber 102 is configured to store the cooling water introduced from the drainage 101. When the pump case 10 is produced by aluminum die-casting or other casting method, this opening 102*a* is opened in the shape of the die used, in the mold-closing direction and mold-opening direction. Note that the opening 102*a* is closed with the attachment member 71 of the electromagnetic clutch 60. The weep chamber 102 is provided with a weep hole 103, opened, which extends in a direction (radial direction) perpendicular to the axial direction at a predetermined height H from a lower end portion of the weep chamber 102 and connects the weep chamber 102 with the outside. This weep hole 103 is directed obliquely downward from the weep chamber 102 to the outside. Therefore, the cooling water (leaked water) is stored in the weep chamber 102 up to the level reaching the weep hole 103 (the predetermined height H). The weep hole 103 is formed by perforation using a cutting tool such as a drill or a reamer.

The attachment member 71 is shaped into a hollow disc, with the axis X at the center, and attached removably to the end surface of the large diameter portion 13*a* at the other end side using a snap ring 74. The attachment member 71 seals the entire opening 102*a* of the weep chamber 102 to prevent the cooling water (moisture) trapped in the weep chamber 102 front leaking to the electromagnetic clutch 60. An O-ring 104 for closing the weep chamber 102 in a fluid-tight manner is provided between the attachment member 71 and the large diameter portion 13*a*.

To facilitate understanding of the present embodiment, characteristic effects of the water pump 1 are described next.

Because the temperature of the cooling water of the engine EG is less than the predetermined temperature upon a cold start of the engine EG, electricity is supplied to the excitation coil 73 of the water pump 1 and the electromagnetic clutch 60 enters a power cut state. As a result of supplying electricity to the excitation coil 73 in the power cut state, the field core assembly 70 generates a magnetic field. The magnetic field of the field core assembly 70 is formed in the opposite direction of the magnetic field of the permanent magnet 91; thus, these magnetic fields cancel each other out. Consequently, the armature 83 is released from the binding of the magnetic field of the permanent magnet 91 (without being affected by the magnetic field) and separates from the pump pulley 20 under the elastic force of the plate s 82, resulting in release of the frictional engagement between the armature 83 and the pump pulley 20. As a result, the water pump 1 enters the non-drive state so the cooling water is not discharged from the water pump 1.

However, when the engine EG is warm (after warming up the engine EG), the temperature of the cooling water of the engine EG becomes equal to or higher then the predetermined temperature. Therefore, the supply of electricity to the excitation coil 73 of the water pump 1 is stopped and the electromagnetic clutch 60 enters a power transmission state. As a result of stopping the supply of electricity to the excitation coil 73 in the power transmission state, the magnetic field of the permanent magnet 91 magnetically pulls the armature 83 to the pump pulley 20 against the elastic force of the plate spring 82. Consequently, the friction surface of the pump pulley 20 and the friction surface of the armature 83 are brought into frictional engagement with each other, whereby the power of the engine EG is transmitted to the drive shaft 30 via the pump pulley 20 and the armature 83 and the impeller 40 rotates integrally with the drive shaft 30. The water pump 1 therefore enters the drive state where the cool water is supplied from the water pump 1 to the engine EG and the engine EG is water-cooled by the effect of the cooling water.

When the water pump i is in the drive state, boundary lubrication in the mechanical seal 50 disposed in the shaft hole 18 prevents the cooling water from leaking from the pump chamber 12 toward the shaft hole 18. However, when the mechanical seal 50 involves foreign matters such as dust, there is a possibility that a small amount of the cooling water leaks toward the shaft hole 18. The cooling water leaking from the mechanical seal 50 is introduced to the draining space 19, flows from this draining space 19 to the weep chamber 102 through the drainage 101, and is stored temporarily in the weep chamber 102. The leaked cooling water can be stored in the weep chamber 102 up to the height H of the weep hole 103. The hatched area shown in FIG. 3 represents the area of the weep chamber 102 in which the leaked cooling water can be stored. The leaked cooling water stored in the weep chamber 102 is subjected to exhaust heat of the engine EG (heat emitted or transferred from the engine EG), facilitating vaporization of the cooling water. The resultant water vapor is discharged from the weep hole 103 to the outside. Moreover, the weep chamber 102 is shaped into an annular space to efficiently secure a spatial volume in the weep chamber 102. Therefore, even when the cooling water Leaks from the mechanical seal 50 in the form of water vapor, the amount of water vapor, which is required until the foregoing water vapor condenses, increases in the weep chamber 102, preventing the formation of dew condensation in the weep chamber 102 (as a result, the water vapor can be discharged as is from the weep hole 103). In this manner, not only is it possible to efficiently dissolve the cooling water accumulated in the weep chamber 102, and but also leakage of the cooling water in the form of droplets from the weep hole 103 of the weep chamber 102 to the outside of the water pump I can be prevented; thus, the risk of misjudging that the water pump 1 has broken down, can be prevented. Because the opening 102*a* of the weep chamber 102 is sealed with the attachment member 71 of the electromagnetic clutch 60, there is no risk that the cooling water accumulated in the weep chamber 102 leaks toward the electromagnetic clutch 60 through the opening 102*a*.

According to the water pump 1 of the present embodiment in which the pump case 10 is provided with the weep chamber 102 for storing the cooling water leaking from the mechanical seal 50, by using the attachment member 71 of the electromagnetic clutch 60 as a cover for sealing the opening 102*a* of the weep chamber 102, water leakage from the water pump 1 can be prevented without using a special cover, thereby reducing the number of parts and assembly processes of the water pump 1 and thus the cost of manufacturing the water pump 1.

Furthermore, the weep chamber 102 is formed as an annular space forming a circle around the axis, to efficiently secure a spatial volume in the weep chamber 102. Therefore, even when the cooling water leaks from the mechanical seal 50 in the form of water vapor, the amount of water vapor, which is required until the foregoing water vapor condenses, increases in the weep chamber 102, preventing the formation of dew condensation in the weep chamber 102. Therefore, water leakage from the water pump 1 can be prevented more effectively.

The present invention is not limited to the foregoing embodiment, and various modifications can be made as appropriate without departing from the gist of the present invention.

According to the foregoing embodiment, a so-called normally-closed electromagnetic clutch where the drive shaft 30 and the pump pulley 20 remain connected to each other when electricity is not supplied is illustrated as the electromagnetic clutch 60. However, the present invention is not limited to this configuration; in the configuration where the pump case 10 is provided with the weep chamber for storing the cooling water leaking from the mechanical seal 50, a normally-open electromagnetic clutch where the drive shaft 30 and the pump pulley 20 are disconnected from each other when electricity is not supplied may be employed as the electromagnetic clutch 60.

In the foregoing embodiment, the attachment member 71 of the electromagnetic clutch 60 is attached to the pump case 10 using the snap ring 74. However, the present invention is not limited to this configuration; the attachment member 71 may be attached using fastening means such as a bolt or a rivet.

Although the foregoing embodiment has illustrated an engine driven water pump, the present invention is not limited to this configuration and may be applied to an electric water pump. The present invention may also be applied not only to a water pump but also to other fluid pumps such as a fuel pump and an oil pump.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fluid pump, comprising:

a housing that has a shaft hole extending in an axial direction and a pump chamber communicating with the shaft hole;

a drive shaft that is provided inside the shaft hole and rotated about an axis by power from a power source;

a rotational bearing provided inside the shaft hole and supporting the drive shaft rotatably;

an impeller that is provided inside the pump chamber and coupled to an end portion of the drive shaft;

an electromagnetic clutch that is provided in the housing and establishes or blocks transmission of the power of the power source to the drive shaft;

a mechanical seal that is located between the impeller and the rotational bearing and is configured by a first sealing member and a second sealing member facing in contact with each other, the first sealing member being provided in an inner circumferential portion of the shaft hole and the second sealing member being provided in an outer circumferential portion of the drive shaft; and storage means that is formed so as to communicate with the shaft hole in the housing and stores fluid leaking from the mechanical seal, wherein the electromagnetic clutch has a core portion that houses a coil for generating a magnetic field, and establishes or blocks the transmission of the power of the power source to the drive shaft by switching between supply and non-supply of electricity to the coil, wherein the storage means has a fluid storage portion that communicates with the shaft hole between the mechanical seal and the rotational bearing and is opened to an end portion in the axial direction, wherein an attachment member for attaching the core portion to the housing seals the opening of the fluid storage portion, wherein the fluid storage portion is configured from an annular space forming a circle around the axis, and surrounding the shaft hole, wherein the fluid storage portion communicates with the shaft hole via a drainage portion, the drainage portion extending in a first radial direction relative to an axis of the drive shaft, the first radial direction being downward, the fluid storage portion being closed at all other radial positions besides a radial position corresponding to the drainage portion, and wherein a discharge portion that connects the fluid storage portion to the outside is provided at a predetermined height from a lower end of the fluid storage portion, and extends in a second radial direction relative to the axis of the drive shaft, the second radial direction being obliquely downward relative to the first radial direction.

* * * * *